United States Patent [19]

Barton et al.

[11] 4,172,693

[45] Oct. 30, 1979

[54] FLEXIBLE BLADED FAN CONSTRUCTION

[75] Inventors: William D. Barton, Plainfield; Donald J. Hartley, Indianapolis; Joseph V. Matucheski, Indianapolis; Michael T. Spellman, Indianapolis; Clifford S. L. Yee, Indianapolis, all of Ind.

[73] Assignee: Wallace Murray Corporation, New York, N.Y.

[21] Appl. No.: 840,398

[22] Filed: Oct. 7, 1977

[51] Int. Cl.[2] ..... F04D 29/38

[52] U.S. Cl. ..... 416/132 A; 416/240; 416/DIG. 3

[58] Field of Search ..... 416/132 R, 132 A, DIG. 3, 416/240; 123/41.11, 41.49, 41.65, 41.69

[56] References Cited

U.S. PATENT DOCUMENTS

| | | | |
|---|---|---|---|
| 3,860,362 | 1/1975 | Bentley et al. | 416/132 A |
| 4,012,168 | 3/1977 | Spellman | 416/DIG. 3 X |
| 4,037,987 | 7/1977 | Charles et al. | 416/240 X |

*Primary Examiner*—Everette A. Powell, Jr.

*Attorney, Agent, or Firm*—Thomas J. Greer, Jr.

[57] ABSTRACT

A flexible fan blade construction of the type wherein a decamber limiter is carried by each spider arm and bears against one side of its associated fan blade to thereby limit flexing (decamber) thereof. According to this invention, the decamber limiter terminates short of the heel of each fan blade. High stress concentrations due to contact between the heel edge of each fan blade and its associated decamber limiter are avoided by this novel construction.

1 Claim, 4 Drawing Figures

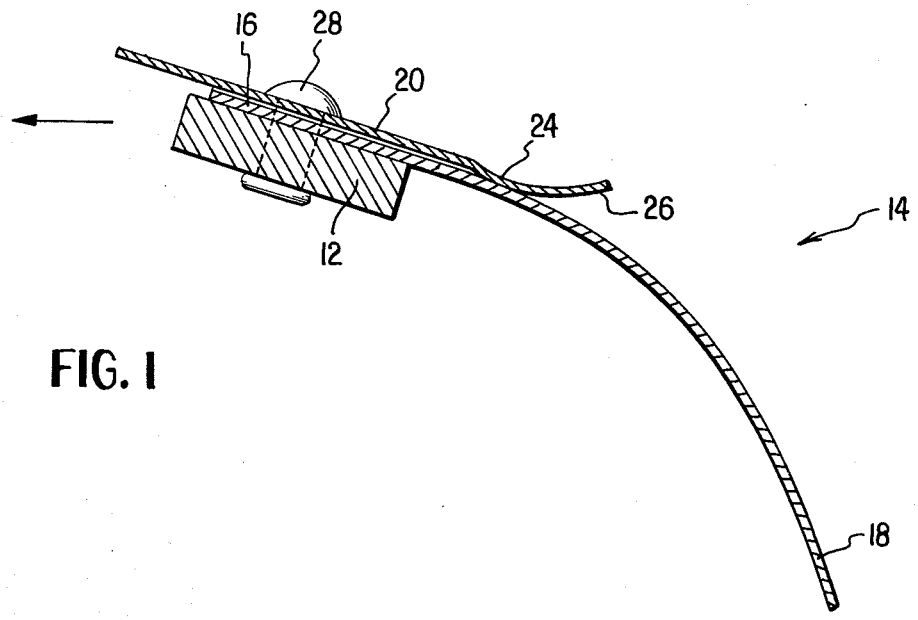
FIG. 1
FIG. 2
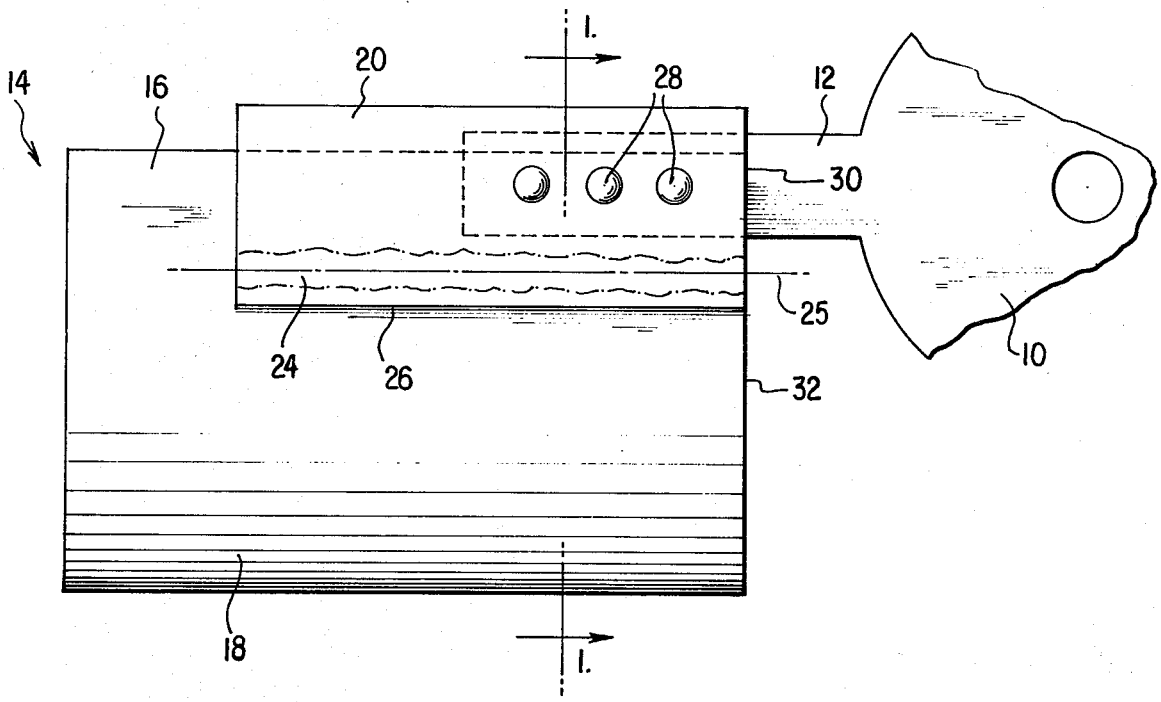

FIG. 3
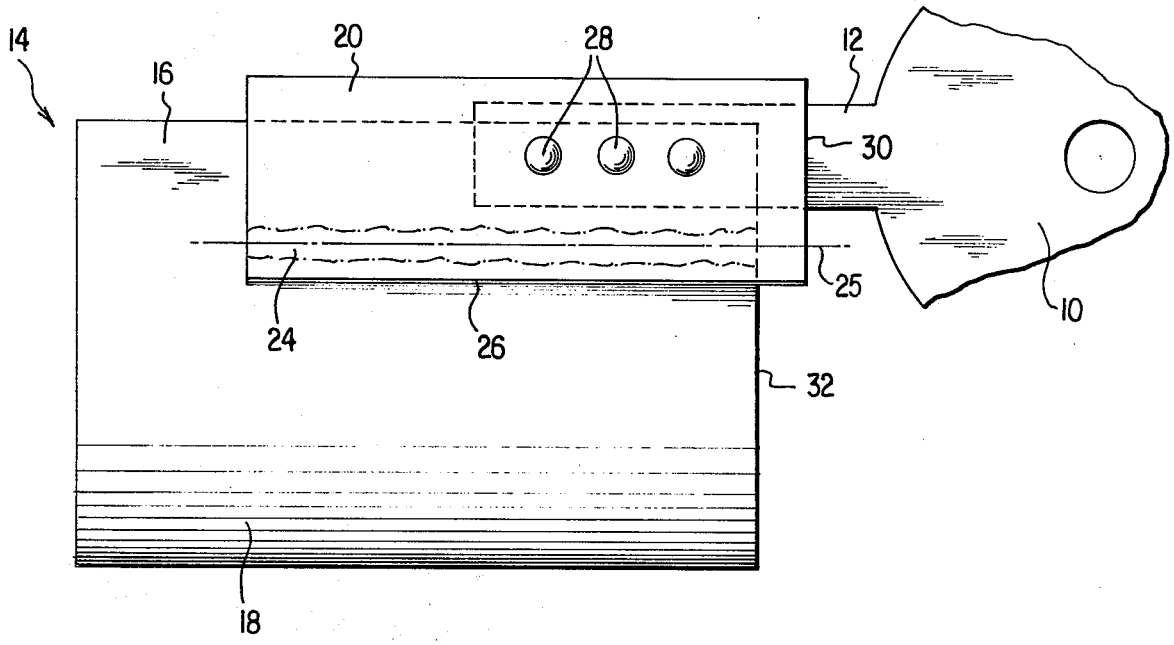
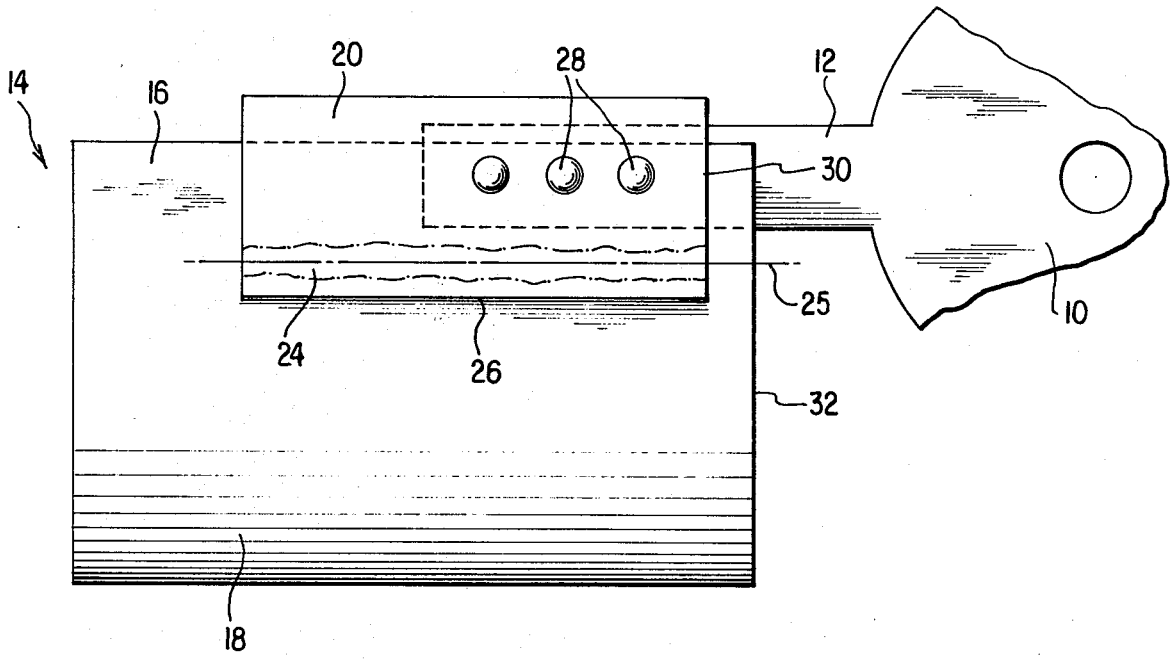
FIG. 4

FLEXIBLE BLADED FAN CONSTRUCTION

This invention relates to a flexible fan construction of the type adapted for installation on the radiator cooling system of an internal combustion engine. The invention is more particularly concerned with a construction which will inhibit high stress concentrations at the heel portion of each of the individual fan blades.

It is common in the internal combustion engine art to cool the radiator of a vehicle by means of a fan, the fan assisting in drawing ambient air through the radiator to cool water or other coolant passing through the radiator from the engine block. In certain automotive or truck installations the use of a flexible fan for this purpose has been employed. In general, a flexible fan is formed of sheet metal and the blades are attached to spider arms. Each blade is curved so that its trailing edge portion extends outside of the plane of rotation of the spider arms. During rotation, the centrifugal and the reaction forces between the fan blades and the air moved by them causes these trailing portions to flex towards the plane of rotation. Thus, upon relatively slow rotational speeds of a flexible fan, the trailing edges of the blades extend relatively far from the plane of rotation. Upon increased speeds of rotation, however, the trailing edges of the individual fan blades move under the action of these forces towards the plane of rotation and thereby move less air for each complete rotation of the fan. At faster vehicle speeds occurring in conjunction with higher fan rotational speeds, less cooling air is required to be moved by the fan. At such faster vehicle speeds, much of the required cooling air is supplied by the ram effect of air entering the radiator system by relative motion of the vehicle through ambient air. Accordingly, the use of flexible fans offers increased fuel economy in certain installations.

The prior art is aware of a number of flexible fan constructions. In one type of construction, a sheet metal decamber limiter or clamp is provided with a radially extending trough. The clamp is attached to each spider arm and the trough thereof makes line contact with a surface of the flexible fan blade. The radially innermost portion of such a sheet clamp is often co-extensive with the heel portion of its associated fan blade. A construction such as this is shown in the following U.S. patents:

U.S. Pat. No. 3,289,924—Weir
U.S. Pat. No. 3,356,154—Cassidy
U.S. Pat. No. 3,373,930—Rom
U.S. Pat. No. 3,406,760—Weir
U.S. Pat. No. 3,773,435—Wooden
U.S. Pat. No. 3,785,748—Gorman
U.S. Pat. No. 3,860,362—Bentley In another typical type of prior art fan construction wherein a sheet clamp is employed having a trough which bears against one surface of its associated fan blade, the sheet clamp extends radially inward beyond the heel of its associated fan blade. Examples of this second type of construction are shown in the following U.S. Patents:

U.S. Pat. No. 3,594,098—Pratinidhi
U.S. Pat. No. 3,639,078—Pratinidhi
U.S. Pat. No. 3,639,079—Pratinidhi
U.S. Pat. No. 3,679,321—Strick
U.S. Pat. No. 3,698,835—Kelly
U.S. Pat. No. 3,711,219—Strick
U.S. Pat. No. 3,728,043—Pratinidhi
U.S. Pat. No. 3,759,630—Freeman U.S. Pat. No. 3,799,697—DeJong
U.S. Pat. No. 3,827,826—Strick
U.S. Pat. No. 3,836,284—DeJong
U.S. Pat. No. 3,910,718—MacEwen Analysis of stresses in such fan blade constructions shows that the line contact between the heel edge of each fan blade and its associated sheet clamp trough often gives rise to high stress concentrations at the regions of such line contact. Thus a stress concentration higher than desired may exist at the blade heel because of its contact with the trough of the sheet clamp or decamber limiter.

According to the practice of this invention, prior art constructions are modified so that the trough which is integral with the decamber limiter terminates short (radially outward) of the heel of each associated fan blade. By virtue of this construction, such undesirable high stress concentrations are avoided.

IN THE DRAWINGS

FIG. 1 is a typical transverse cross-sectional view of a flexible fan blade of the type including an associated clamp or decamber limiter having an integral trough therein.

FIG. 2 is a partial plane view of a typical prior art fan construction of the type shown in the first group of patents above-mentioned.

FIG. 3 is a view of a portion of a typical prior art flexible fan construction of the type shown in the second group of patents above-mentioned.

FIG. 4 is a view similar to FIGS. 2 and 3 and illustrates the construction of this invention.

Referring now to FIG. 1 of the drawings, a typical transverse cross-section of a flexible fan construction includes a spider arm 12 to which is rigidly fastened a flexible fan blade denoted generally by the numeral 14. The leading edge portion of the fan blade is generally flat and is denoted by the numeral 16, while the numeral 18 denotes the curved, trailing edge portion. The numeral 20 denotes a sheet clamp (decamber limiter) having an integral trough 24 running radially thereof and having a trailing edge 26. Trough 24 normally abuts the indicated surface of flexible blade 14 in a resilient manner so that when the trailing edge 18 of the fan blade 14 tends to move into the plane of rotation of the spider arm 12 under the action of centrifugal and aerodynamic forces, it is resisted by the resilient action of sheet clamp 20 acting through trough 24. The trough makes line contact with the blade, this being indicated by the dashed line 25 of FIG. 2. The trough is there indicated by the short, connected arcs running parallel to the line contact. The numeral 28 denotes any one of a plurality of fastening elements such as rivets for rigidly securing the sheet clamp 20, the fan blade 14, and the spider arm 12 together. Viewed at FIG. 1, the trailing edge is to the right and the leading edge of the blade is to the left, the arrow indicating the plane of rotation of the spider arm.

Referring now to FIGS. 2 and 3 of the drawings, typical prior art constructions are illustrated. Referring firstly to FIG. 2, the numeral 10 denotes a disc having an axis of rotation normally or orthogonally through its center and provided with a plurality of integral, radially extending spider arms 12 angularly spaced from each other. The numeral 32 denotes the blade heel of a typical fan blade (only one such blade and spider arm illustrated), the heel being the radially innermost portion of the blade. The numeral 30 denotes the radially innermost portion of the clamping sheet 20 and the reader will observe that these edge portions are substantially co-extensive. The construction of FIG. 2 is such that there is contact between a portion of the trough 24 and the heel 32 of the blade. At this point of contact, relatively high stress concentrations at the blade heel may occur.

Referring now to FIG. 3 of the drawings, another typical prior art type of construction is illustrated wherein the radially innermost portion 30 of the sheet clamp member 20 extends radially inward beyond the blade heel of the fan blade 14. The reader will observe that the trough 24 again intersects and thus contacts the blade heel 32. Such intersection, as noted above, may result in high stress concentrations at the blade heel.

Referring now to FIG. 4 of the drawings, the novel construction according to this invention is illustrated. The reader will observe that the clamp or decamber limiter 20 is fashioned in such a manner that its radially innermost edge 30 terminates radially outward of blade heel 32. Accordingly, there is no contact between heel 32 and trough 24 and thus no stress concentrations can occur at the blade heel due to contact with trough 24.

What is claimed is:

1. A sheet metal fan construction for a radiator cooling system, the fan construction being of the type including a fan spider defined by a central disc having integral, radially outward extending arms, the disc adapted to rotate about an axis passing centrally and orthogonally therethrough, a flexible fan blade rigidly attached to each spider arm, each fan blade having a leading edge, a trailing edge, and a heel portion, the heel portion being the radially innermost part of the fan blade, each fan blade being curved so that it extends away from the plane of rotation of the spider arms, a decamber limiter having a trough extending therealong in a radial direction, the trough making line contact with and bearing against one surface of its associated fan blade, the improvement comprising, each decamber limiter terminating radially outward of the heel portion of its associated fan blade, whereby high stress concentrations at the heel of the fan blade due to contact with the trough of the decamber limiter are avoided.

* * * * *